United States Patent [19]

Royal et al.

[11] 4,401,155

[45] Aug. 30, 1983

[54] HEAT EXCHANGER WITH EXTRUDED FLOW CHANNELS

[75] Inventors: John H. Royal, Grand Island; Lawrence S. Graczyk, Hamburg; William J. Owens, Kenmore, all of N.Y.

[73] Assignee: Union Carbide Corporation, Danbury, Conn.

[21] Appl. No.: 234,258

[22] Filed: Feb. 13, 1981

[51] Int. Cl.[3] ..... F28F 3/00

[52] U.S. Cl. ..... 165/166; 165/170

[58] Field of Search ..... 165/166, 170

[56] References Cited

U.S. PATENT DOCUMENTS

| | | | |
|---|---|---|---|
| 1,662,870 | 3/1928 | Stancliffe | 165/166 |
| 2,804,285 | 8/1957 | Peterson | 165/166 |
| 3,137,785 | 6/1964 | Norton | 219/345 |
| 3,202,212 | 8/1965 | Kritzer | 165/179 |
| 3,205,563 | 9/1965 | Pauls et al. | 29/157.3 |
| 3,247,583 | 4/1966 | Hansson et al. | 29/157.3 |
| 3,415,316 | 12/1968 | Burne et al. | 165/164 |
| 4,114,597 | 9/1978 | Erb | 126/271 |
| 4,116,271 | 9/1978 | De Lepeleire | 165/166 |
| 4,150,719 | 4/1979 | Thielen et al. | 165/166 X |

FOREIGN PATENT DOCUMENTS

| | | | |
|---|---|---|---|
| 875280 | 3/1953 | Fed. Rep. of Germany | 165/166 |
| 2332047 | 1/1975 | Fed. Rep. of Germany | 165/166 |
| 3011011 | 9/1980 | Fed. Rep. of Germany | 165/166 |
| 55-152397 | 11/1980 | Japan | 165/166 |

*Primary Examiner*—William R. Cline
*Assistant Examiner*—John F. McNally
*Attorney, Agent, or Firm*—Stanley Ktorides

[57] ABSTRACT

A heat exchanger constructed from a plurality of stacked modules, each module having closed channels for high pressure flow and fins extending vertically up and/or down from the channels which form open channels suitable for low pressure flow when the modules are stacked parallel along their length.

6 Claims, 10 Drawing Figures

FIG. 5
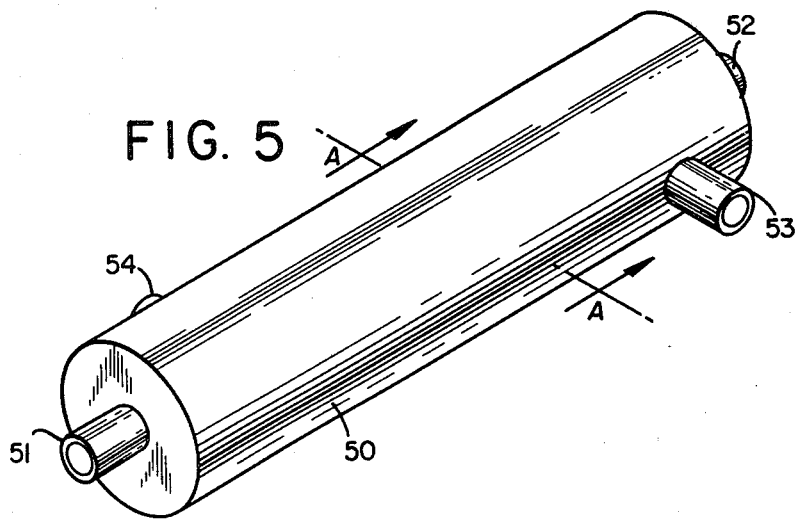
FIG. 5a
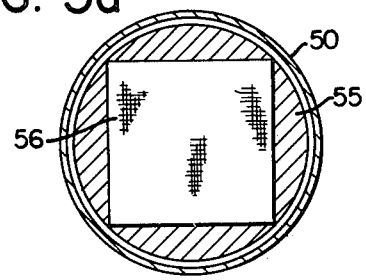
VIEW A A
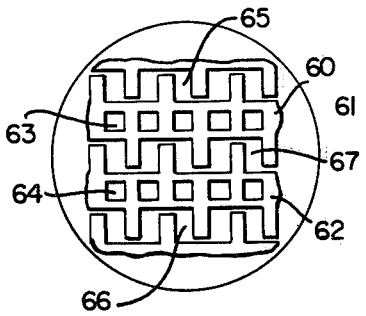
FIG. 5b

HEAT EXCHANGER WITH EXTRUDED FLOW CHANNELS

BACKGROUND OF THE INVENTION

Many chemcial and separation processes involve heat exchange among the process streams in order to improve the energy efficiency of that process. For many such processes, operation at high pressure is advantageous in that it improves thermal efficiencies. However, high pressure heat exchanger operation places severe restrictions on the heat transfer equipment.

High pressure service involves capability to sustain the fluid pressure and thereby involves relatively heavy structures associated with the heat transfer equipment. Apart from the heavy walls that are required for individual heat transfer fluid passages, high pressure requirements make manifolding requirements severe. Additionally, it is difficult for high pressure heat exchange units to attain high reliability in that each joint associated with the heat exchanger unit exposed to high pressure service is a possible source of leakage. Further, it is difficult to fabricate heat exchangers of large size due to size limitations on parts imposed by the fabrication equipment.

Accordingly it is an object of this invention to provide an improved heat exchanger for high pressure process applications.

It is another object of this invention to provide an improved heat exchanger for high pressure applications that is easly and economically fabricated.

It is another object of this invention to provide a heat exchanger for high pressure applications that is easily and economically fabricated into a large unit.

It is another object of this invention to provide a heat exchanger for high pressure applications wherein the number of joints required per given size is reduced.

It is another object of this invention to provide a heat exchanger for high pressure applications that can be effectively headered for multiple stream applications.

SUMMARY OF THE INVENTION

The above and other objects which will be readily apparent to those skilled in the art are accomplished by the present invention which comprises:

A heat exchanger comprising a plurality of modules stacked parallel wherein each module comprises:

(a) a plurality of channels each having a continuous metal boundary around its cross-sectional perimeter and open at either end, said channels running parallel to one another and in the same plane, being generally equispaced and of generally uniform cross-sectional size and shape, and (b) a plurality of metal fins, each fin extending substantially along the length of the module and perpendicular to the flow direction of the channels above or below the channels, said fins being of generally uniform thickness and having an identical dimension perpendicular to said channels.

DESCRIPTION OF THE DRAWINGS

FIG. 5 illustrates a two stream heat exchanger of this invention.

FIG. 5*a* illustrates a cross-sectional view of FIG. 5 at line A—A.

FIG. 5*b* illustrates an enlarged view of a detail of FIG. 5*a*.

DESCRIPTION OF THE INVENTION

This invention is a heat exchanger which can be easily constructed by stacking two or more modules. The heat exchanger can thus be easily made into any size and particularly into large sizes. This alleviates one problem often encountered in practice, especially where high pressure flow is desired, namely the limitation on the overall size of the heat exchanger because of difficulty in fabricating large size components and sharply escalating costs due to increasing complexity of construction as the overall heat exchanger size is enlarged.

The modules which are stacked to form the heat exchanger of this invention contain a plurality of closed channels, i.e. channels open at either end of their length but enclosed along their length in metal, and a plurality of fins extending perpendicular from the channel flow direction. The fins form channels when the modules are stacked one on top of another; these channels may be termed open channels. Thus, the heat exchanger is formed by alternating rows of closed and open channels. The closed channels are particularly suited to high pressure flow and the open channels are particularly suited for low pressure flow. Thus, the heat exchanger of this invention is particularly suited for situations where one heat exchange stream is at high pressure and another stream is at low pressure. Further, because the individual modules contain no joints or other connections, they can be easily extruded. This greatly reduces fabrication costs for the individual modules and construction costs for the heat exchanger itself.

Figure 1:
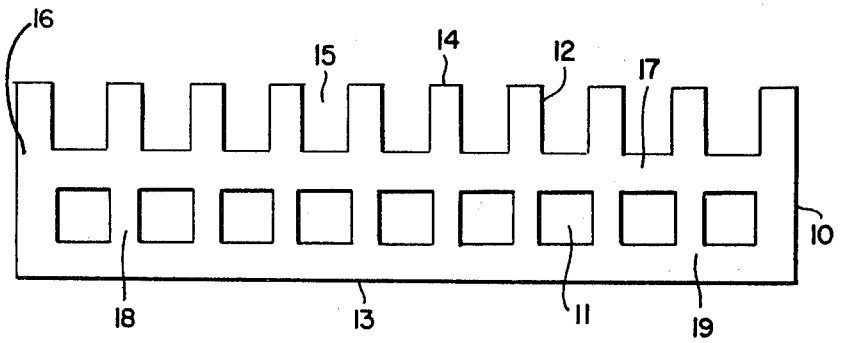
FIG. 1 is a cross-sectional view of one embodiment of a module useful in constructing the heat exchanger of this invention.

The cross section of a typical module is illustrated in FIG. 1. As can be seen from that illustration, the module involves an element that incorporates a row of closed flow channels and a row of external fin elements. Generally, the closed flow channel is rectangular or square in shape although that requirement is not absolute. For example, it may be that certain applications would require a circular cross section or other geometric shape. However, it is expected that the multiple flow channels associated with each module will be of a similar shape and generally aligned in a regularly spaced row. Likewise, the external fins associated with the extrusion module are again generally rectangular in cross section, parallel, and regularly spaced. for some applications, it may be that the cross section of the fins can advantageously be non-rectangular, but it is expected that the rectangular cross section will be preferred for most applications. Preferably, the fins extend above or below the spacing between the channels but they may, if desired, extend directly above or below the channels themselves. All fins of the module will terminate in a straight line (in cross section but, of course, planar for the actual module) so that during stacking of the individual modules, as will be explained, there will be formed open flow channels. For the FIG. 1 illustration, the extruded module in cross-section 10 is illustrated with square closed flow channels 11 and rectangular external fins 12. The fins are formed on only one side and the other side 13 is flat so that a columnar stacking of modules would reesult in the end 14 of external fins abutting the flat side 13 of the adjacent module. Such stacking of the modules would then result in another row of fluid flow channels 15 which can be considered open flow channels in that they are not formed by a continuous metal boundary. In contrast, the closed flow channel fluid passages 11 are formed by a continuous metal boundary. It should be noted that the metal thicknesses associated with the extrusion module 10 do not have to be uniform. Thus, it may be that the thickness of the end members 16 can be greater than the metal wall 18 segregating the closed flow channels or the metal wall 17 and 19 between the external fins and the flat side wall. The particular dimensions associated with the side walls and fin thickness will depend on design applications in terms of desired linear density of closed flow channel apertures and external fin and pressure capability of the module for process flow. Generally, it is expected that thicker walls associated with the closed flow channels will result in high pressure capability for those channels. The particular dimensional parameters associated with the modulle will be a function of process application requirements both from a pressure requirement and heat transfer requirement combined with the capability of the extrusion fabrication technique. Note further that it is expected that the same type of considerations would be controlling in terms of overall size of the module in terms of height, width and length of that module.

Figure 2:
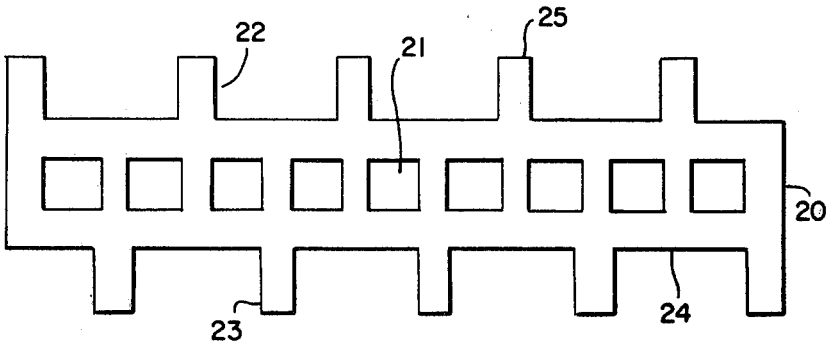
FIG. 2 is a cross-sectional view of another embodiment of a module useful in constructing the heat exchanger of this invention.

Attached FIG. 2 illustrates an alternate module 20 that utilizes external fins on both sides. As with the standard module, this module is composed of a regular row of closed flow channels 21 but includes the variation of external fins 22 and 23 on the opposite sides. Note that these external fins are spaced at an increased distance and in a staggered arrangement so that stacking of adjacent modules would cause the flat end of the fin such as 25 to abut the flat surface of an adjacent module such as 24. As with the basic module, the result will be the formation of a row of open flow channels on either side of the closed flow channel associated with the modules as shown. It is expected that the two sided external fin arrangement as shown on FIG. 2 may have advantages associated with ease of extrusion but yet yield a resultant heat exchanger core with relatively high fin densities obtained by stacking the individual modules.

Figure 3:
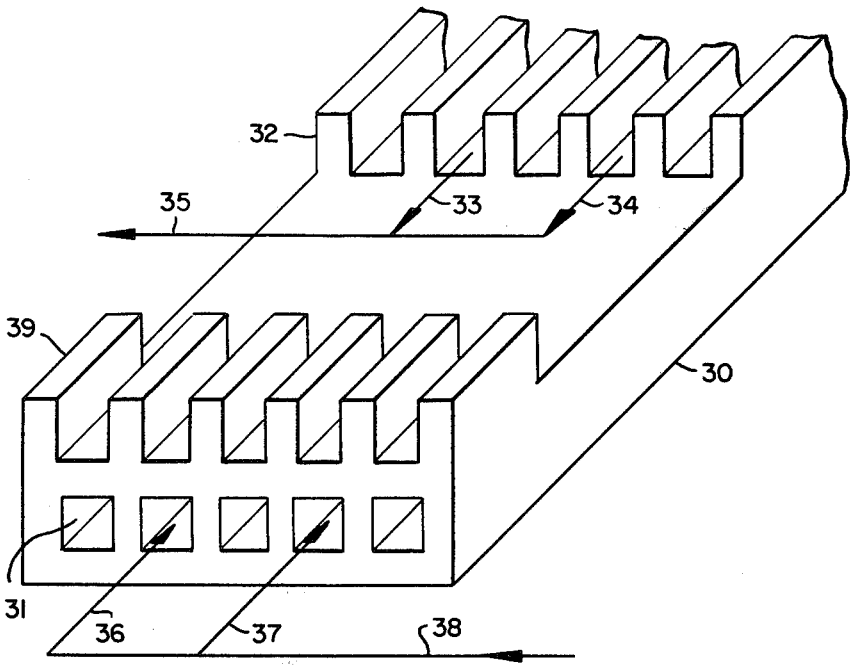
FIG. 3 illustrates fluid flow paths associated with a module.

The modules shown in cross-section in FIGS. 1 and 2 are the basic building block of a heat exchanger that is advantageous for parallel flow high pressure process applications. The heat exchanger arrangement associated with this building block element involves the stacking of multiple modules together to form the heat exchanger core as required. The particulr resultant fluid flow path and arrangement involved with such stacking can be better understood by examining FIGS. 3 and 4. FIG. 3 shows process fluid flow paths that can be associated with a module as shown in cross-section in FIG. 1. FIG. 3 not only illustrates the fluid flow path but also illustrates a feature that is required or advantageous to manifold the muliple fluid flow paths associated with each module into composite process streams. Such manifolding is required as it would be in a tube-and-shell or plate-and-fin type heat exchanger as is well understood by those skilled in the art. As can be seen from FIG. 3, module 30 is shown in isometric view with associated flow paths. Note that the closed flow channels such as 31 will carry one process stream 38 which must be appropriately manifolded into each closed channel such as 36 and 37. The fluid stream that is transferring heat with process stream 38, that is stream 35, is set up to flow between the external fins or the open flow passages 33 and 34 that are formed when another module would be stacked with 30. In order to manifold the individual fluid flow passages associated with spaces between the external fins, it is necessary to remove a section of the external fin 32 so that the fluid from the individual passages can be combined with flow across the module. Such a removal of external fins at the end of the module is a convenient way of manifolding the multiple flow passages by allowing the individual passages to be combined in a traverse flow path. Note that the illustration shows remaining fin sections 39 at the end but it does not require that these fin sections be retained. If those sections were removed, then the individual modules could be combined in a standard tube sheet type arrangement whereby the end of the module would be connected to the tube sheet to manifold all of the closed channel fluid passages and the removal of the fins at the end would allow for traverse flow and thereby manifolding of all the open channel flow passages. Such an arrangement is similar to that associated with tube and shell type construction whereby the tubes must be connected to a tube sheet to manifold multiple tubes for one process stream and shell side or flow on the outside of the tubes must then be connected for the other side. It is of interest to note, however, that the module associated with this invention reduces the joints required for manifolding purposes in that essentially each closed flow channel can be thought of as a tube and including multiple flow channels within the single module thereby reduces the joining required to manifold the arrangement into a suitable heat exchanger arrangement.

Figure 4:
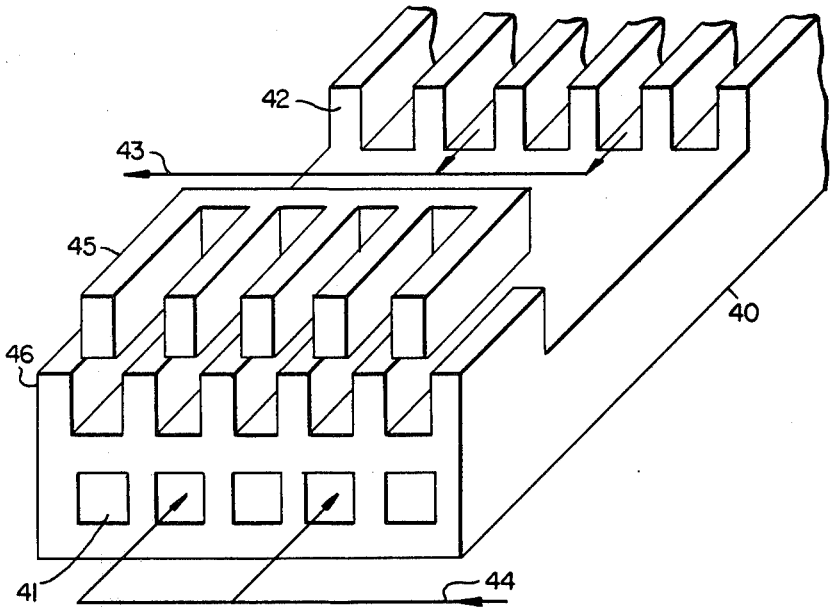
FIG. 4 illustrates a flow channel headering option that can be utilized with each module.

An option for the headering and thereby fluid passage manifolding associated with individual modules is illustrated in FIG. 4. Basically the module 40 illustrated is similar to that of FIG. 3 except that it is combined with another metallic comb-like member 45. This metallic member is formed by combined fin-like elements so that it closely fits between the remaining section 46 of the external fins at the end. When this comb member is positioned, it then results in the formation of an essentially solid metal block at the end of the module. As before, a traverse section of fin is removed 42 to allow the manifolding of the open flow passages in stream 43. Likewise another stream 44 is manifolded into the multiple closed channel passages 41. The addition of the comb member enhances the manifolding of the individual modules in that stacks of such modules would then allow a single weld across the ends of the comb section to result in complete sealing of the core stack. It is expected that such manifolding arrangement would considerably simplify manifolding a core based on the stacked module arrangement.

The basic combination of the individual modules to form a parallel flow heat exchanger is illustrated in FIG. 5. As can be seen, the heat exchanger is formed by stacking individual modules so that the flat sidewall portion of one module abuts the flat fin ends of the adjacent module. The heat exchanger core is formed by stacking the modules on top of each other and adjacent to each other as required to form the necessary cross sectional flow area for the heat exchanger. The length of the heat exchanger is determined by the length of the stacked modules. The arrangement illustrated in the FIG. 5 arrangement is the basic two stream arrangement whereby one stream is associated with the manifolded closed flow passages and the other stream is associated with the manifolded open flow channels. As noted, the stacking arrangement results in a parallel flow arrangement which can thereby be either cocurrent or countercurrent processes flow with typically the countercurrent process flow being preferred from a thermal efficiency standpoint. As illustrated in the FIG. 5 embodiment, the entire heat exchanger core formed from the stacked modules can be contained in a suitable pressure shell 50. This pressure shell is then combined with suiitable baffles and vessel heads and nozzles at the ends of the shell to form the overall heat exchanger arrangement. The one stream 51 can be introduced through end nozzle and header associated with that stream and flow through the multiplicity of closed flow channels through the length of the heat exchanger and then be removed at the other end as stream 52. On the other hand, the second stream can be introduced through side header 53 which would have associated baffle plates as required to direct the fluid flow as previously explained (across the removed fin sections) so that the stream would then flow through the multiplicity of the open flow channels through the length of the heat exchanger and be removed in a similar fashion at the other end as stream 54. The particular arrangement can be better visualized by examining cross sectional view AA whereby the main heat exchanger core section 56 is shown as the stacked array of modules. This stacked array is then contained in the pressure shell 50 and suitably baffled along each side by baffle plates 55. These baffle plates 55 ensure that fluid flow does not occur in an axial direction between the stacked core section and the pressure containing shell. However, it is not necessary for each module to be connected by welding or other suitable means along the side to prevent fluid from passing into these vessel sections. The open flow channels are not formed mechanically, but are simply formed by physical placement of adjacent modules. Note that the pressure associated with the open channel stream 53 can be contained by vessel shell 50. On the other hand, the pressure associated with other process stream 51 is contained by the closed flow channels themselves. Of course, it is necessary that the pressure be suitably contained by the end manifolding associated with the core section, that is, that pressure must be borne by the tube sheet or connections associated with joining the individual modules and, of course, the end header and nozzle associated with the introduction of the single process stream into the multiple closed flow channel passages. For further illustration purposes, the particular arrangement of the stacked modules is illustrated in detail B or enlarged cross section 60. Essentially this arrangement shows two adjacent modules 61 and 62 which in this case include external fins on both sides stacked so that there are formed open flow channel passages 65 and 66 and 67 along with the closed flow passages 63 and 64 associated with each module. As described, these passages are then manifolded in relatively standard tube and shell type arrangements.

FIG. 5 illustrates a preferred embodiment of the heat exchanger of this invention in that it shows the stacked modules enclosed in a shell. However, this option is not required and the individual stacked modules may be welded together to form a heat exchanger with no external shell. Thus, the heat exchanger of this invention need comprise only the stacked modules and thus it is self-supporting with side welds.

Although the basic manifolding of individual modules is similar to methods utilized with tube and shell or plate and fin type prior art type heat exchanger units, the headering capability of this improved heat exchanger can result in flexible process stream arrangements. Particular aspects of the headering may be unique as for example, one option illustrated in FIG. 6. Basically, this headering option shows an arrangement that allows multiple stream manifolding for the closed flow channels. The option illustrates that a stacked core section can be subdivided into one section 70 and another section 80 by a suitable plate member 75. This plate member 75 could be used to subdivide a heat exchanger core so that a tube sheet used to header the closed flow channels would then be in two sections. This would then allow two, or more, closed flow channel process streams. For example, in FIG. 6 the core section 80 formed from stacked modules such as 81 and 82 would be associated with one process stream 83 whereas the other core section 70 associated with stacked modules 71 and 72 would be associated with closed channel flow stream 73. As shown, the process flow stream associated with the open channel flow passages 74 could be associated with both core sections but the dividing plate 75 could be utilized to subdivide that flow, also if so desired. Essentially, this arrangement would simply allow some additional stream headering flexibility in the sense that the heat exchanger arrangement associated with the stacked module technique would not be limited to a two stream arrangement. This flexibility is very advantageous in many process applications that involve multiple streams for the heat exchanger.

Figure 6:
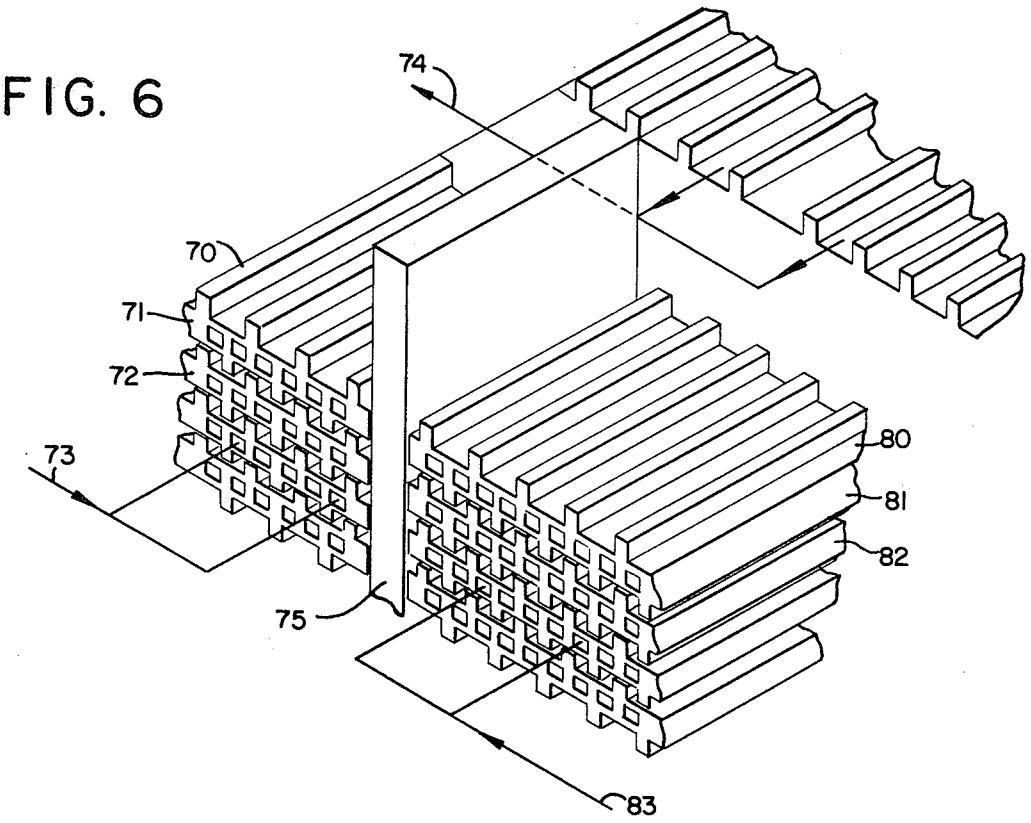
FIG. 6 illustrates a module headering option that allows multiple closed channel streams for a heat exchanger core formed from stacked individual modules.
Figure 7:
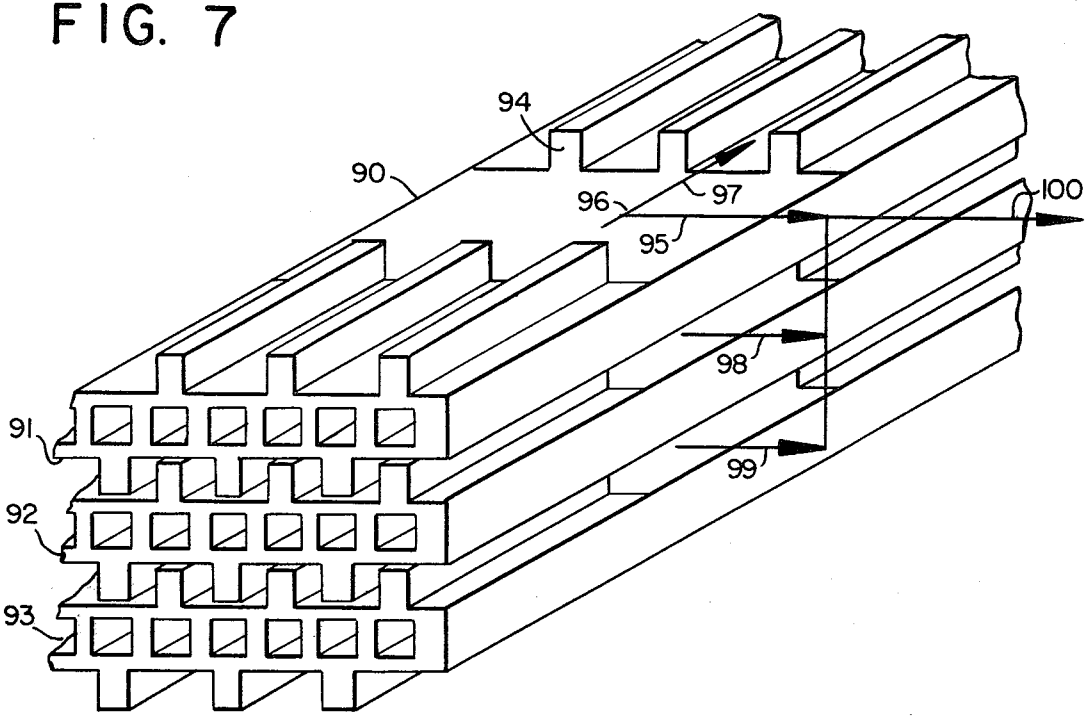
FIG. 7 illustrates a manifolding option that can be utilized to remove or add fluid flow on the fin side of the stacked modules.

FIG. 6 illustrates one option available for multistream headering of core sections formed from stacked modules. Other headering options are available associated with side headering of a stacked core section. Such side headering may be advantageous for cases where fluid flow must be added or removed intermediate to the ends of the heat exchanger core section. Basically such an arrangement is illustrated by the core subsection 90 of FIG. 7. Essentially, side stream headering can be accommodated by removal of fin section 94 at the desired point along the length of the overall stacked core section. As illustrated, the arrangement shows subsections of stacked modules 91, 92 and 93. As the fluid passes in the open channel side of the stacked array as illustrated by stream 96, the removal of the fin section would allow removal of some fluid 95 with remaining fluid continuing 97 down the length of the core section. In similar fashion, some fluid 98 and 99 from adjacent passages would be removed and all fluid removed would be combined for side stream 100. The arrangement is illustrated schematically but it will be appreciated by those skilled in the art that this is a readily adaptable method for such side stream headering by simple flow baffling within the shell to channel fluid 100 into an appropriate side header for removal from the heat exchanger unit itself. Of course, it is understood that fluid can be added to the heat exchanger in a similar fashion. Note that the arrangement involves side heading of the open channel process stream only. It would be difficult to perform similar side headering on the closed channel flow stream without subdividing the overall heat exchanger arrangement into multiple core sections. Of course, that option is available if desirable for heat exchanger process applications.

Figure 8:
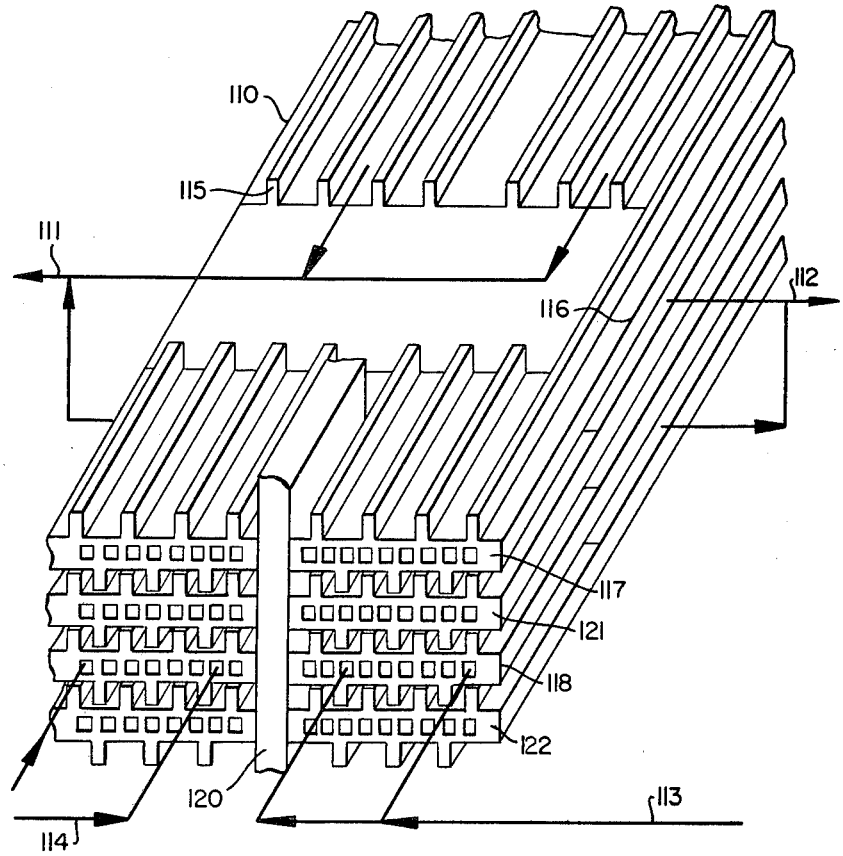
FIG. 8 illustrates multiple stream headering options associated with a heat exchanger core formed from stacked individual modules.

Still another headering option available with the high pressure heat exchanger of this invention is illustrated in FIG. 8. This arrangment shows the combined headering option of a segregating plate. Basically the subsection 110 illustrated shows the use of a plate member 120 to separate high pressure headering into one flow stream 114 and another flow stream 113. Additionally, the headering details the capability to header the open channel flow stream of alternate passages to separate sides of the core section. As explained before, a traverse section of the external fin 115 is removed to allow headering of the open channel process stream. However, the difference in this case is that alternate modules such as 117 and 118 retain a side external fin 116 so that the stack results in channeling the open channel process stream 111 to the opposite side. On the other hand, the alternate module such as 121 and 122 would retain a corresponding side fin on the opposite side and thereby channel the flow to the other side. Thus, stream 112 would be the open channel flow associated with alternate passages compared to stream 111. Such headering arrangements are somewhat akin to those utilized with standard plate and fin type arrangements and again illustrate the similarity between this type of heat exchanger and the known units. Of key importance is the fact that this type of heat exchanger has considerable process stream headering flexibility and thereby is not limited to simple two stream applications, but can effectively handle multistream applications as required for a variety of process applications.

Although this invention is not restricted to any particular design parameters associated with the individual module or overall heat exchanger arrangement, some parameter ranges can be suggested. The basic extruded module such as FIG. 1 or 2, that is the building block of the unit can have a height ranging from about $\frac{1}{4}$ to 1 inch or more and a width ranging from about 2 to 12 inches or more. The length of the extruded core can be relatively short at three feet or extremely long of about 100 feet or more. This length factor is attractive in that by nature of the extrusion fabrication, the length is not limited by fabrication machinery or furnaces as is often the case with other heat exchanger types. It is expected that typically the fin linear density and the closed flow channel linear density will range from as little as 3 to 25 units per inch. It is expected that the density of these flow apertures and external fins would be related to the pressure capability of the module with decreased densities associated with high pressure capability. Dimensions for a typical module may be about $\frac{1}{4}$ inch high and about $2\frac{1}{4}$ inches wide with a length of about 20 feet. It is expected that fins might be typically 40 mils thick and about 75 mils high. The closed flow channels would typically be rectangular in cross section with a dimension of about 60 mils and the linear aperture and fin density about 10 per inch. Although the pressure capability of the system will depend on the particular design application, it is expected that this type of heat exchanger is highly advantageous for increased pressure in that the closed flow channel is ideally suited to contain high pressure. It is expected that pressure capability of the unit would range from about 300 to as high as 6000 psia but more preferably it is expected that such extruded heat exchanger would be advantageous for pressure capability of about 1000 to 2000 psia.

The modules which are stacked to form the heat exchanger of this invention can be made of any suitable metal. However, it is preferable that the modules be made of aluminum because of aluminum's superior heat transfer properties and superior extrudability.

The heat exchanger of this invention is suitable for parallel flow, either cocurrent or countercurrent. That is to say that the heat exchange streams may run in the same direction or in opposite directions but not at right angles, except proximate to the headering connection.

The heat exchanger of this invention provides an economical means of heat exchange at high pressure, particularly due to the few connections that must be made internally. The modules are simply stacked to attain the desired heat exchanger size. However, the modules may be welded or otherwise mechanically connected if this is desired.

The heat exchanger of this invention is particularly suited for high pressure applications and especially where one heat exchange stream is at high pressure and another is at low pressure. This situation occurs in many applications such as cryogenic processes, particularly fluid liquefier processes and liquid pumping oxygen processes.

What is claimed is:

1. A heat exchanger comprising a plurality of modules stacked parallel, and unconnected, to one another, said plurality enclosed in a shell wherein each module comprises:

(a) a plurality of channels each having a continuous metal boundary around its cross-sectional perimeter and open at either end, said channels running parallel to one another and in the same plane, being generally equispaced and of generally uniform cross-sectional size and shape, and (b) a plurality of metal fins, each fin extending substantially along the length of the module and perpendicular to the flow direction of the channels, above or below the channels, said fins being of generally uniform thickness and having an identical dimension perpendicular to said channels.

2. The heat exchanger of claim 1 wherein said channel cross-sectional shape is essentially rectangular.

3. The heat exchanger of claim 1 wherein said metal is aluminum.

4. The heat exchanger of claim 1 wherein said fins extend above and below the channels.

5. The heat exchanger of claim 1 wherein said fins extend above or below the spacing between the channels.

6. The heat exchanger of claim 1 wherein said fins and said channels each have a linear density of from 3 to 25 per inch.

* * * * *